US007624477B2

(12) United States Patent
Chien et al.

(10) Patent No.: US 7,624,477 B2
(45) Date of Patent: Dec. 1, 2009

(54) ROTATION HINGE

(75) Inventors: Chin-heng Chien, Tu-Cheng (TW); Te-hung Yin, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 583 days.

(21) Appl. No.: 11/583,016

(22) Filed: Oct. 19, 2006

(65) Prior Publication Data

US 2008/0047104 A1 Feb. 28, 2008

(30) Foreign Application Priority Data

Aug. 25, 2006 (TW) ..... 95215178 U

(51) Int. Cl.
*E05F 1/08* (2006.01)

(52) U.S. Cl. ..... 16/286; 16/341

(58) Field of Classification Search ..... 16/284, 16/286, 296, 325, 341; 379/433.13; 455/575.3, 455/575.4

See application file for complete search history.

(56) References Cited

U.S. PATENT DOCUMENTS 2,095,866 A * 10/1937 Hallenbeck ..... 16/325
5,031,270 A * 7/1991 Lee ..... 16/50
7,496,194 B2 * 2/2009 Jeun ..... 379/433.11
2005/0137000 A1 * 6/2005 Toh et al. ..... 455/575.4
2007/0039132 A1 * 2/2007 Jung et al. ..... 16/325

* cited by examiner

*Primary Examiner*—Victor Batson
*Assistant Examiner*—Matthew Sullivan
(74) *Attorney, Agent, or Firm*—Rosenberg, Klein & Lee

(57) ABSTRACT

A rotation hinge configured in a portable electrical device includes a tube sequentially stringing a base coupled to a main housing of the portable electrical device, a cam module and a fixing plate coupled to a sub-housing of the portable electrical device, and engaging with a riveting plate. The cam module has a designed curve surface and at least two recesses positioned thereon. Each section of the designed curve surface between the recesses has an arc-shape projection portion. Each recess of the designed curve surface contacts an elastic sliding portion. While the cam module rotates, the elastic sliding portion moves from the recess and moves along the designed curve surface. While the elastic sliding portion contacts the arc-shape projection portion, a compression force stored in the elastic sliding portion is maximized. Therefore, the sub-housing is advanced to rotate by the elastic sliding portion releasing the compression force.

19 Claims, 7 Drawing Sheets

ROTATION HINGE

BACKGROUND OF THE INVENTION

1. Field of the Invention

The invention relates to a rotation hinge, and particularly to a rotation hinge configured in a portable electrical device capable of allowing a sub-housing of the portable electrical device rotating on a main housing of the portable electrical device.

2. The Related Art

According to the current development of communication technology, portable electrical devices such as mobile phones, personal digital assistants and others, are capable of providing wireless communication. One kind of the portable electrical devices includes a rotation-type configuration. The rotation-type configuration has a rotation hinge configured therein capable of allowing a sub-housing of the portable electrical devices rotating on a main housing of the portable electrical devices. In consideration of carrying and downsizing issues, the sub-housing rotates above the main housing to an open position for the operation purpose. Otherwise, the sub-housing rotates to cover the main housing to a close position for an idle or standby situation.

There is a rotation-type wireless communication device disclosed in United States Patent Application Publication No. 2004/0018862. It shows the wireless communication device including a first housing with a housing support and a second housing positioned upon the housing support, or a portion thereof, so that the second housing may rotate around the housing support. Also, the second housing includes a circular portion positioned upon the housing support, and an extending portion extends from the circular portion. When the device is in a closed position, the circular and extending portions of the second housing are adjacent to the first housing. When the device is in an opened position, the circular portion is adjacent to the first housing and the extending portion is away from the first housing. In addition, the second housing may have multiple positions relative to the first housing in which each position activates a particular function of the device.

However, the above described rotation-type wireless communication device generally needs to be opened and closed by separately gripping each housing portion and repositioning or rotating the housing portion relative to one another. This generally requires that the user free up both hands for opening the rotation-type wireless communication device. Consequently, there is a need for a self-operating opening and closed mechanism for configuring in a hand-held portable electrical device to make the housing portion self-rotating to one another.

SUMMARY OF THE INVENTION

An object of the present invention is to provide a rotation hinge configured in a portable electrical device capable of allowing a sub-housing of the portable electrical device rotating on a main housing of the portable electrical device.

According to the invention, the rotation hinge includes a tube sequentially stringed a base fixed to the main housing of the portable electrical device, a cam module and a fixing plate fixed to the sub-housing of the portable electrical device, and engaged with a riveting plate to make the base, the cam module and the fixing plate sequentially stack. The cam module has a designed curve surface with at least two recesses. Each section of the designed curve surface between the recesses has an arc-shape projection portion. Each recess of the designed curve surface connects an elastic sliding portion.

While the sub-housing of the portable electrical device rotates on the main housing of the portable electrical device by receiving a external force, the cam module also rotates following the rotation of the sub-hosing of the portable electrical device. The elastic sliding portion moves from the recess of the cam module and then moves to the arc-shape projection portion of the cam module according to the rotation of the cam module, and thus stores a compression force. While the elastic sliding portion contacts the arc-shape projection portion of the cam module, the compression force stored in the elastic sliding portion is therefore maximized. In consequence, the cam module and the sub-housing of the portable electrical device are advanced to rotate together because the elastic sliding portion releases the compression force to press the designed curve surface of the cam module.

Another object of the present invention is to provide a rotation hinge configured in a portable electrical device capable of allowing a sub-housing of the portable electrical device rotating clockwise and anti-clockwise on a main housing of the portable electrical device.

According to the invention, the cam module of the rotation hinge has an upper cam and a lower cam. The upper cam has a first recess and a second recess arranged at the designed curve surface. Further, the lower cam has a third recess and a fourth recess arranged at the designed curve. The arc-shape projection portion of the upper cam adjoins one side of the first and second recesses. However, the arc-shape projection portion of the lower cam adjoins exclusive side of the third and fourth recesses. A first elastic sliding portion and a second elastic sliding portion respectively contact the first recess of the upper cam and the third recess of the lower cam.

In this case, the cam module and the sub-housing of the portable electrical device will be advanced to rotate clockwise together according to the first elastic sliding portion presses the designed curve surface of the upper cam by releasing the compression force stored therein. Furthermore, because the designed curve face of the lower cam is pressed by the compression force releasing from the second elastic sliding portion, the cam module will be advanced to rotate anti-clockwise. So the sub-housing of the portable electrical device will be brought to rotate anti-clockwise via the rotation of the cam module.

A further object of the present invention is to provide a rotation hinge configured in a portable electrical device capable of allowing a sub-housing of the portable electrical device rotating on a main housing of the portable electrical device to an open position.

According to the invention, the base has a block portion. A rotation plate having an opening and a rotation disc having a stopping portion are sequentially arranged upon the cam module. The stopping portion of the rotation disc is arranged in the opening of the rotation plate. While the sub-housing of the portable electrical device rotates on the main housing, the rotation plate also rotates to follow the sub-housing. The opening of the rotation plate will connect the stopping portion of the rotation disc.

In this case, the rotation disc is advanced to rotate by the rotation of the rotation plate after the opening of the rotation plate connects the stopping portion of the rotation disc. While the stopping portion of the rotation disc rotates to contact the block of the base, the block blocks the rotation of the rotation plate and the rotation disc. Therefore, the sub-housing of the portable electrical device rotates on the main housing of the portable electrical device to the open position.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
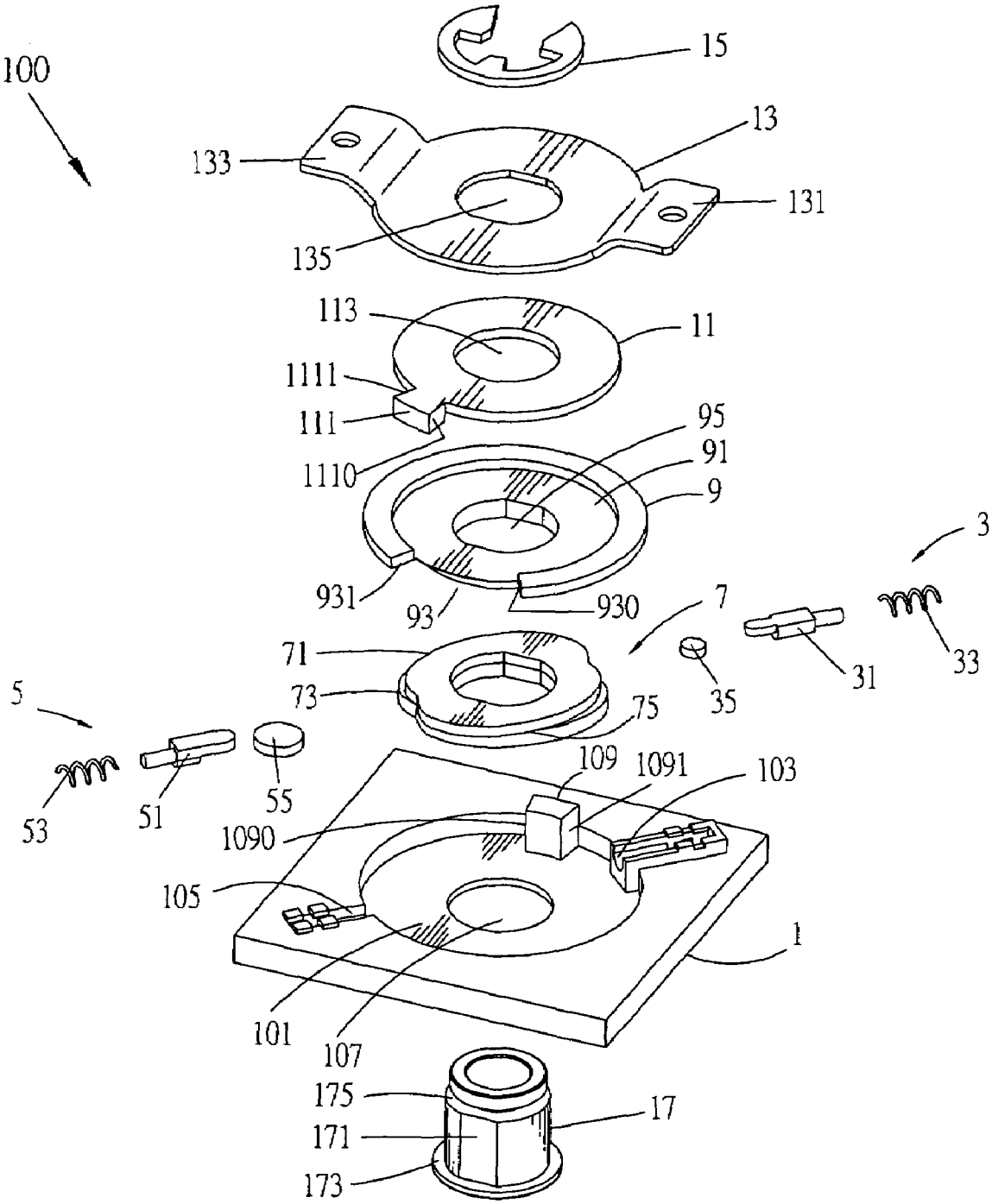
FIG. 1 shows an exploded view of a rotation hinge according to the present invention.
Figure 2:
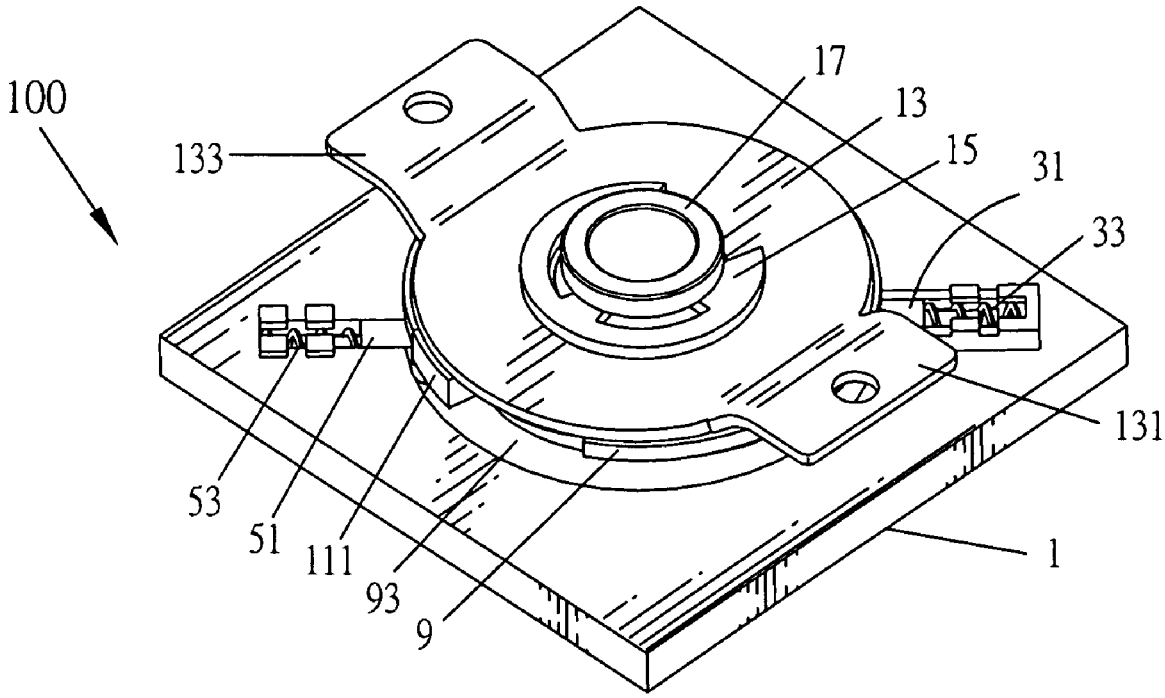
FIG. 2 is a perspective view of the rotation hinge.
Figure 5:
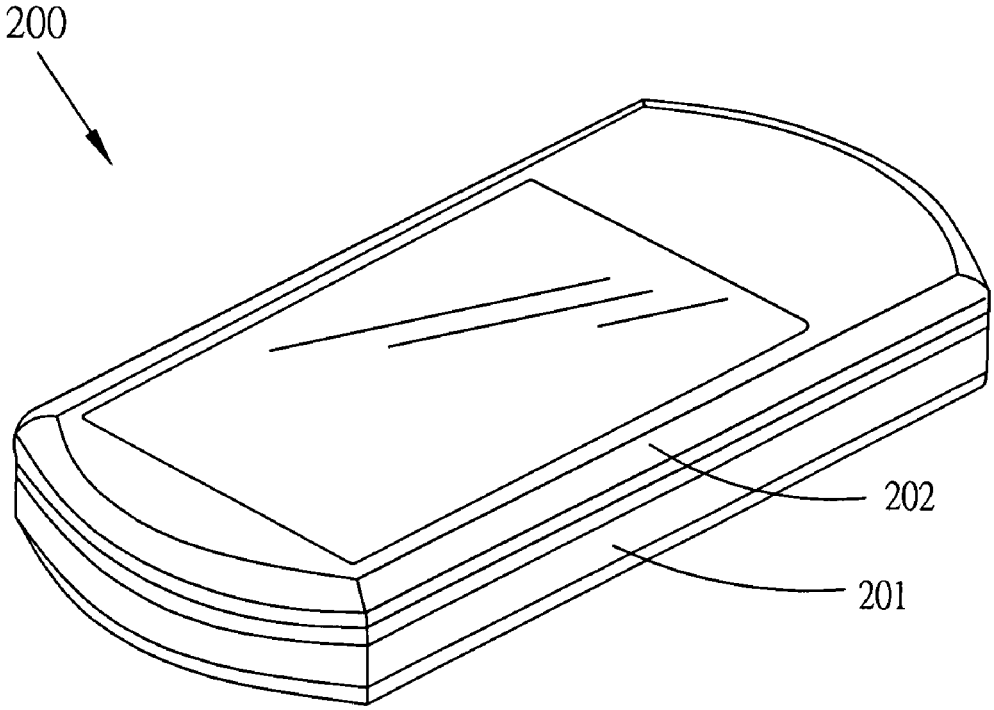
FIG. 5 is a perspective view showing a portable electrical device configured with the rotation hinge in a close position.

Firstly referring to FIG. 1, FIG. 2 and FIG. 5, a preferred embodiment of a rotating hinge 100 according to the present invention is configured in a portable electrical device 200. In this case, the portable electrical device 200 is a mobile phone. The rotating hinge 100 includes a tube 17 sequentially stringed a base 1, a cam module 7, a rotation plate 9, a rotation disc 11 and a fixing plate 13, and engaged with a riveting plate 15. Therefore, the cam module 7, the rotation plate 9, the rotation disc 11, the fixing plate 13 and the riveting plate 15 are sequentially stacked. In this case, the base 1 couples to a main housing 201 of the mobile phone 200 and the fixing plate 13 couples to a sub-housing 202 of the mobile phone 200.

The base 1 includes a receiving space 101 formed in an up surface of the base 1. A first groove 103 and a second groove 105 are horizontally formed in the base 1. The first groove 103 is arranged higher than the second groove 105. One end of the first and second grooves 103, 105 respectively leads to the receiving space 101. A first through hole 107 perpendicularly through the base 1 is arranged at a central area of the receiving space 101 of the base 1. A block 109 is positioned in the receiving space 101 of the base 1 and connects inner wall of the receiving space 101 of the base 1.

Figure 3:
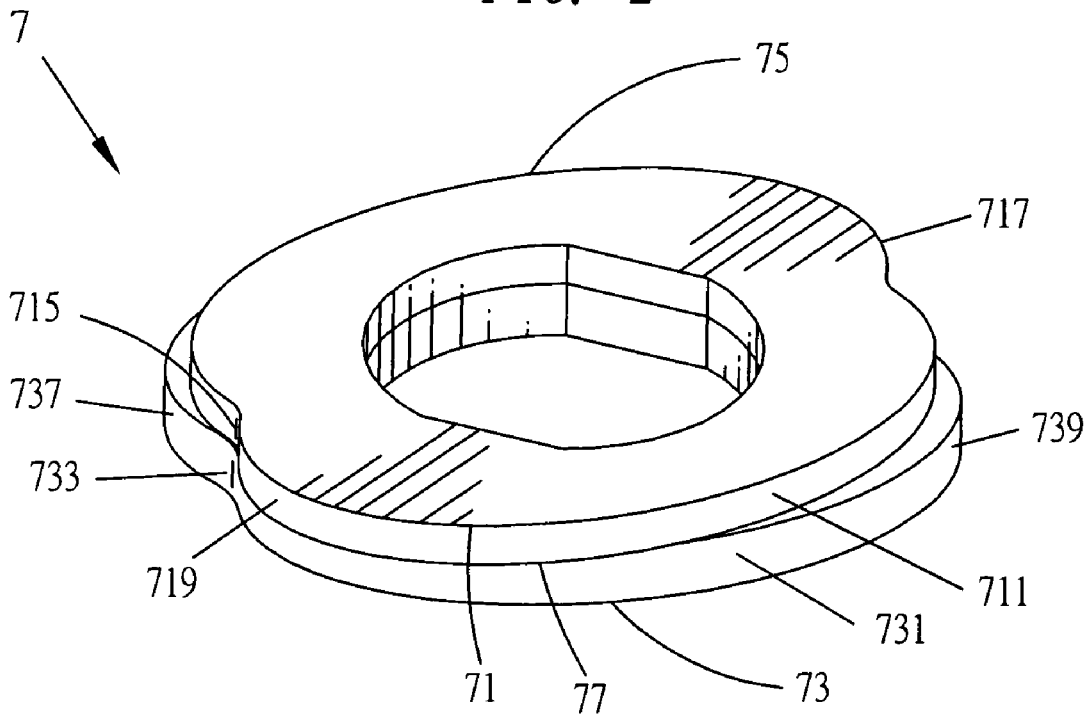
FIG. 3 is a perspective view showing a front side of a cam module of the rotation hinge.
Figure 4:
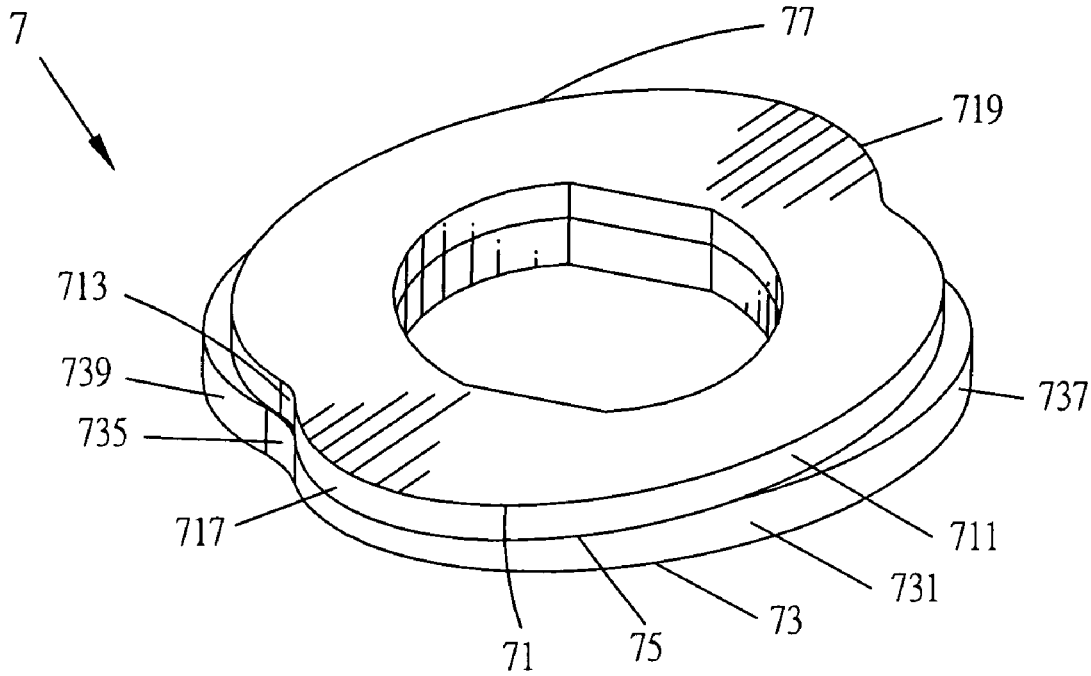
FIG. 4 is a perspective view showing a rear side of the cam module of the rotation hinge.

Referring to FIG. 1, FIG. 3 and FIG. 4, the cam module 7 is received in the receiving space 101 of the base 1. The came module 7 has an upper cam 71, a lower cam 73 connected to the upper cam 7, and a first engaging through hole 75 perpendicularly through the cam module 7. The upper cam 71 has a designed curve surface 711, a first recess 713 and a second recess 715. The first and second recesses 713, 715 are positioned on the designed curve surface 711 respectively. The lower cam 73 also has a third recess 733 and a fourth recess 735 respectively positioned on a designed curve surface 731 of the lower cam 73. In this case, the first recess 713 of the upper cam 71 is opposite to the second recesses 715 of the upper cam 71 and the third recess 733 of the lower cam 73 is opposite to the fourth recesses 735 of the lower cam 73. Furthermore, the first recess 713 of the upper cam 71 leads to the fourth recesses 735 of the lower cam 73 and the third recess 733 of the lower cam 73 leads to the second recess 715 of the upper cam 71.

Each section of the designed curve surfaces 711, 731 between the recesses 713, 715 and 733, 735 respectively have arc-shape projection portions 717, 719 and 737, 739. Further, the arc-shape projection portions 717, 737 respectively adjoin the first recess 713 (FIG. 4) and the third recess 733 (FIG. 3), and are arranged at a first side 75 of the upper cam 71 and the lower cam 73. The arc-shape projection portions 719, 739 respectively adjoin the second recess 715 (FIG. 3) and the fourth recess 735 (FIG. 4), and are arranged at the other side 77 of the upper and lower cam 71, 73 opposite to the first side 75 of the upper and lower cam 71, 73. In this case, the arc-shape projection portions 717, 719 of the upper cam 71 are exclusively arranged to the arc-shape projection portions 737, 739 of the lower cam 73.

Figure 6:
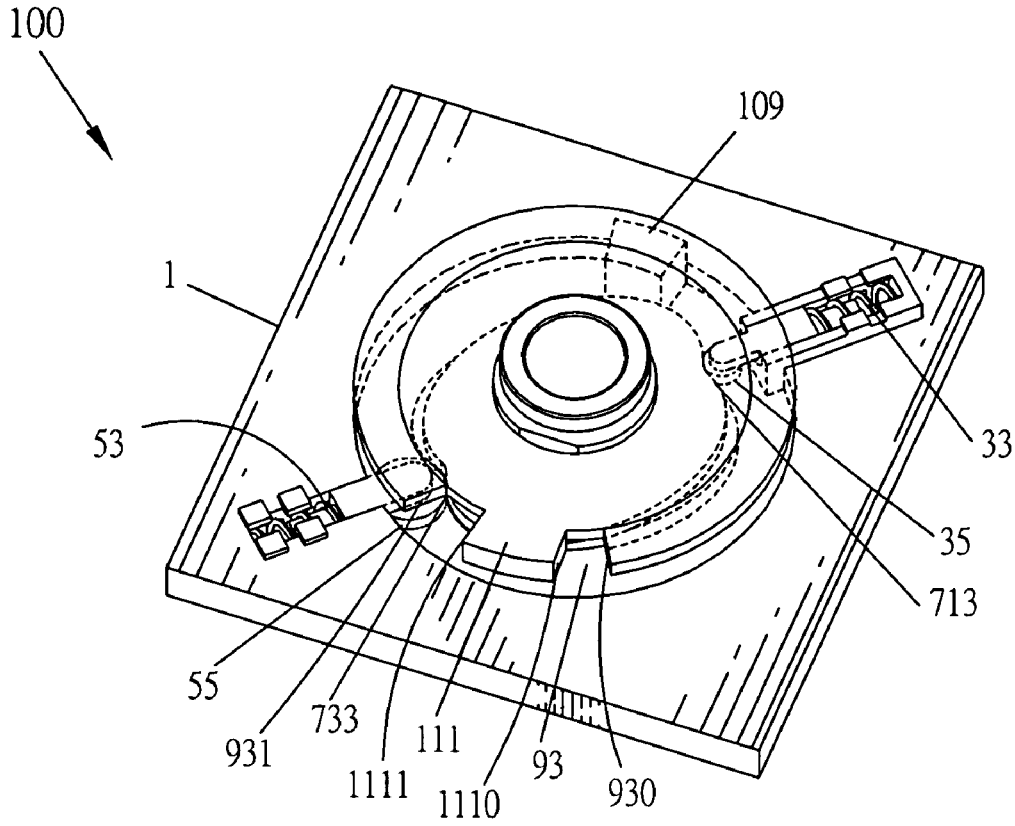
FIG. 6 is a perspective view showing the rotation hinge in the close position.

Please refer to FIG. 1 and FIG. 6. A first elastic sliding portion 3 includes a sliding shaft 31, a compression spring 33 and a roller 35. Particularly, a second elastic sliding portion 5 is similar to the first elastic sliding portion 3. The second elastic sliding portion 5 also has a sliding shaft 51 and a compression spring 53 and a roller 55. For instances, the sliding shafts 31, 51 of the first and second elastic sliding portion 3, 5 are respectively passed through the compression spring 33, 53 and received in the first and second grooves 103, 105. The roller 33, 35 respectively couple to the sliding shafts 31, 51 and contact the first recess 713 of the upper cam 71 and the third recess 733 of the lower cam 73.

Referring to FIG. 1 and FIG. 2 again, the rotation plate 9 is located upon the cam module 7 having a rotation space 91 formed in a surface of the rotation plate 9. An opening 93 is opened at one side of the rotation plate 9 and leaded to the rotation space 91. A second engaging through hole 95 is formed in a central area of the rotation space 91 and perpendicularly through the rotation plate 9. The rotation disc 11 is received in the rotation space 91 having a stopping portion 111 projected from an edge of the rotation disc 11 and located in the opening 93 of the rotation plate 9, and the second through hole 113 perpendicularly through the rotation disc 11. The fixing plate 13 is located upon the rotation disc 11 having fixing portions 131, 133 arranged at an edge of the fixing plate 13 for coupling to the sub-housing 202 of the mobile phone 200, and the third engaging through hole 135 opened in central area of the fixing plate 13 and perpendicularly through the fixing plate 13.

Still referring to FIG. 1 and FIG. 2, the riveting plate 15 is located upon the fixing plate 13. In this case, the riveting plate 15 is an E-ring for securing and assembling purposes. The tube 17 includes a post-shape body 171, a bottom portion 173 arranged at one end of the post-shape body 171 and a neck portion 175 formed in another end of the post-shape body 171. Furthermore, a diameter of the bottom portion 173 is bigger than a diameter of the post-shape body 171 and a diameter of the neck portion 175 is smaller than the diameter of the post-shape body 171.

Please refer to FIG. 1 and FIG. 2 again. While the rotation hinge 100 is assembled, the post-shape body 173 of the tube 17 sequentially passes through the first through hole 107 of the base 1, the first engaging through hole 75 of the cam module 7, the second engaging through hole 95 of the rotation plate 9, the second through hole 113 of the rotation disc 11 and the third engaging through hole 135 of the fixing plate 13. Moreover, the post-shape body 171 of the tube 17 engages with the cam module 7, the rotation plate 9 and the fixing plate 13. In this case, the bottom portion 175 of the tube 17 contacts a bottom surface of the base 1 and the riveting plate 15 engages with the neck portion 175 of the tube 17. Therefore, the base 1, the cam module 7, the rotation plate 9, the rotation disc 11, the fixing plate 13 and the riveting plate 15 are sequentially stacked. That is to say, while the sub-housing 202 of the mobile phone 200 rotates on the main housing 201 of the mobile phone 200, the cam module 7, the rotation plate 9 and the fixing plate 13 would be brought to rotate by the tube 17.

As shown in FIG. 5 and FIG. 6, while the sub-housing 202 of the mobile phone 200 is in a close position, therefore the rotation hinge 100 is in the close position, the block 109 of the base 1 is arranged the opposite to the stopping portion 111 of the rotation plate 9. The rollers 35, 55 of the first elastic portion 3 and the second elastic portion 5 respectively contact the first recess 713 of the upper cam 71 and the third recess 733 of the lower cam 73. The first and second elastic portions 3, 5 will be stored no compression force if the distance between the rollers 35, 55 of the first and second elastic sliding portions 3, 5 and the grooves 103, 105 of the base 1 is the longest.

Figure 7:
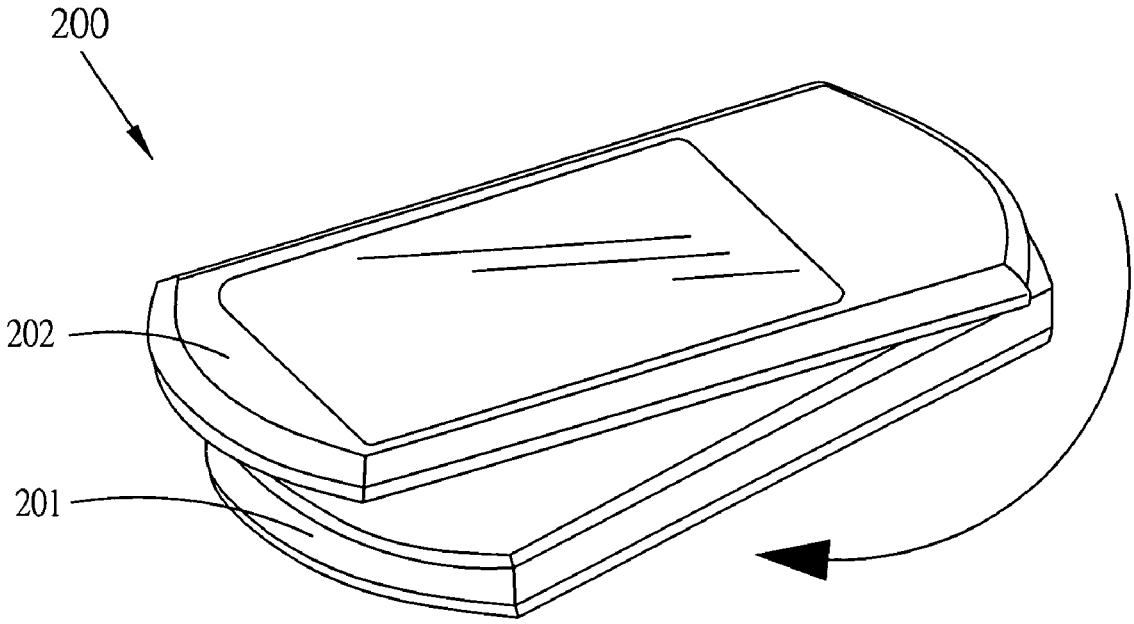
FIG. 7 is a perspective view showing a sub-housing of the portable electrical device rotating clockwise on a main of the portable electrical device.
Figure 8:
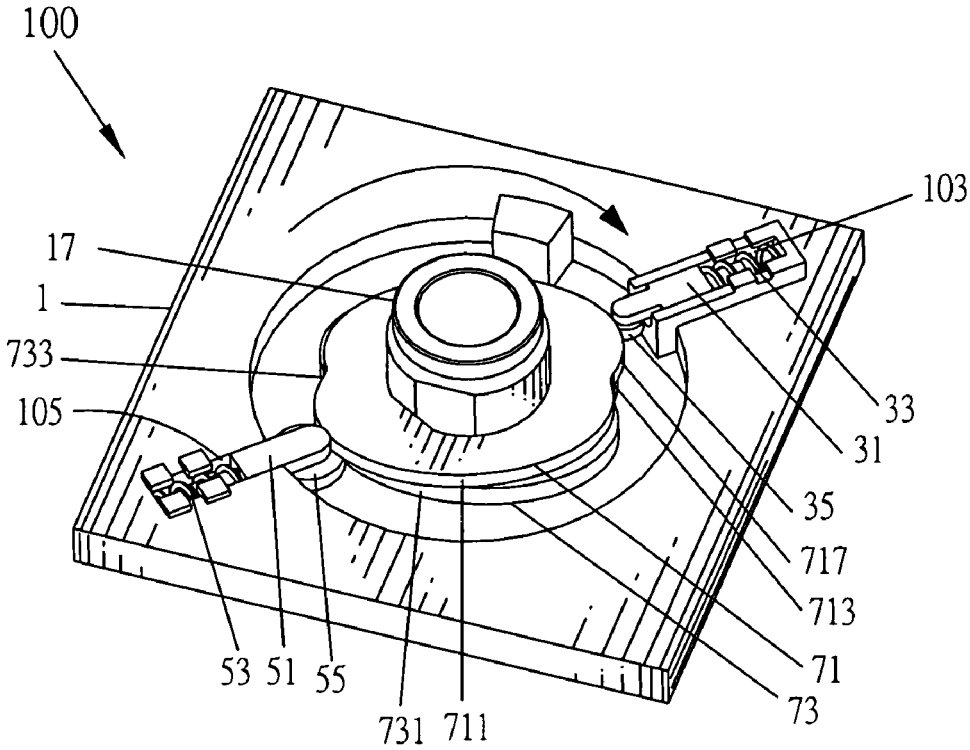
FIG. 8 is a perspective view showing the cam module of the rotation hinge rotating clockwise.

Please refer to FIG. 7 and FIG. 8. While the sub-housing 202 of the mobile phone 200 rotates clockwise on the main housing 201 of the mobile phone 200 by receiving an external force, the cam module 7 would be brought to rotate clockwise by the tube 17. The rollers 35, 55 of the first and second elastic sliding portions 3, 5 respectively move out the first recess 713 of the upper cam 71 and the third recess 733 of the lower cam 73. Therefore, the roller 35 of the first elastic sliding portion 3 moves to the arc-shape projection portion 717 along the designed curve surface 711 of the upper cam 71. Thus the first and second elastic sliding portions 3, 5 are respectively and progressively pushed to slide to the grooves 103, 105 by rotation of the upper and lower cams 71, 73 and the sliding shafts 31, 51 respectively push the compression spring 33, 53.

Referring to FIG. 8, again, the distance between the rollers 35, 55 and the grooves 103, 105 are getting close. So the compression springs 33, 53 of the first and second elastic sliding portions 3, 5 progressively store compression force by receiving a pushed force from the sliding shafts 31, 51. While the roller 35 of the first elastic sliding portion 3 just moves on the arc-shape projection portion 717 of the upper cam 71, the compression force stored in the compression spring 33 is therefore maximized and thus the distance between the roller 35 of the first elastic sliding portion 3 and the groove 103 of the base 1 is the shortest.

Still referring to FIG. 8, while the sub-housing 202 of the mobile phone 200 and the cam module 7 of the rotation hinge 100 still rotate clockwise together, the roller 35 of the first elastic portion 3 moves out the arc-shape projection portion 717 of the upper cam 71. Therefore, the cam module 7 is advanced to rotate clockwise by the compression force releasing from the compression spring 33 of the first elastic sliding portion 3. The rollers 35, 55 of the first and second elastic sliding portions 3, 5 respectively move to the second recess 715 of the upper cam 71 and the fourth recess 735 of the lower cam 73 along the designed curve surfaces 711, 731 of the upper and lower cams 71, 73. The distance between the rollers 35, 55 of the first and second elastic sliding portions 3, 5 and the grooves 103, 105 of the base 1 is getting far away.

In FIG. 6, while the sub-housing 202 of the mobile phone 200 and the cam module 7 of the rotation hinge 100 rotate clockwise together, the rotation plate 9 would be brought to rotate clockwise by the tube 17. A first side 930 of the opening 93 of the rotation plate 9 firstly contacts a first side 1110 of the stopping portion 111 of the rotation disc 11 for modifying a rotation degree of the rotation hinge 100 and then the rotation disc 11 would rotate clockwise following the rotation plate 9.

Figure 9:
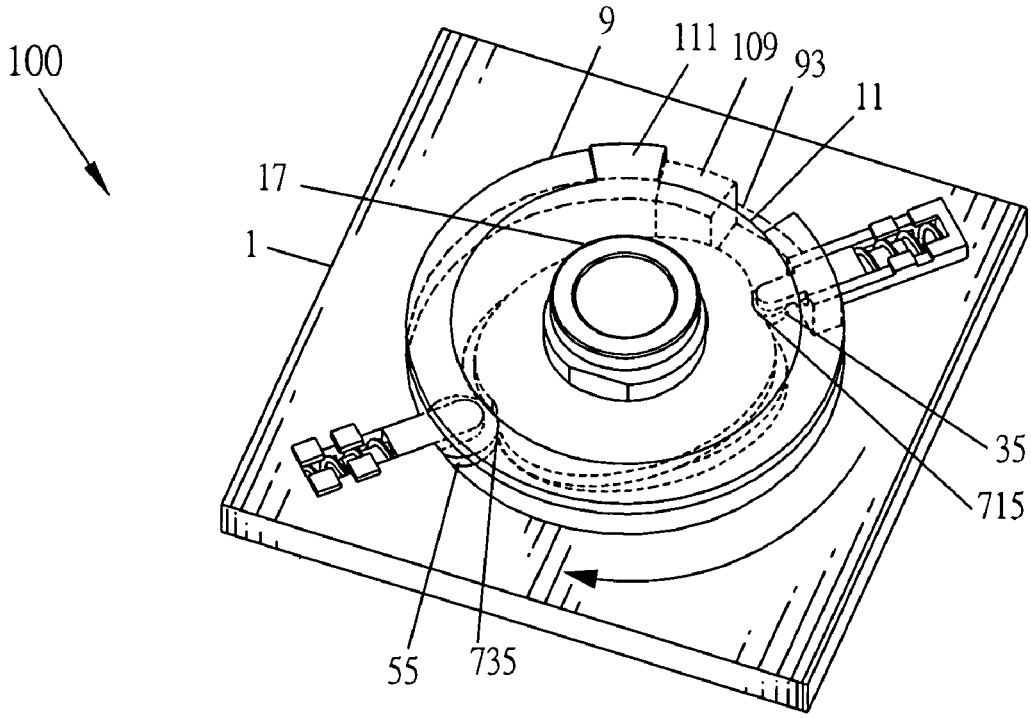
FIG. 9 is a perspective view showing the rotation hinge rotating clockwise to an open position.
Figure 10:
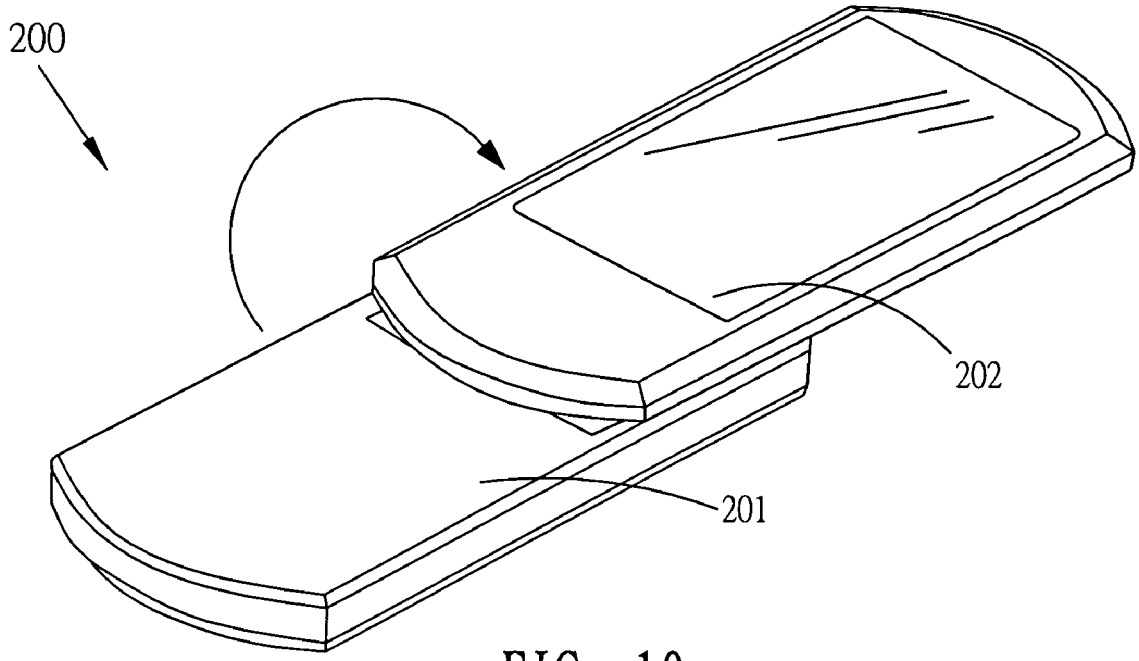
FIG. 10 is a perspective view showing the portable electrical device rotating clockwise to the open position.

As shown in FIG. 9 and FIG. 10, while the sub-housing 202 of the mobile phone 200 and the cam module 7 of the rotation hinge 100 rotate clockwise to an open position, in this case, the sub-housing 202 and the cam module 7 rotate clockwise to 180 degree, the rollers 35, 55 of the first and second elastic sliding portions 3, 5 respectively contact the second recess 715 of the upper cam 71 and the fourth recess 735 of the lower cams 73. The distance between the rollers 35, 55 of the first and second elastic sliding portions 3, 5 and the grooves 103, 105 of the base 1 is back to the longest. A second side 1111 of the stopping portion 111 of the rotation disc 11 opposite to the first side of the stopping portion 111 contacts a first side 1090 of the block 109 of the base 1 and then the block 109 blocks the stopping portion 111 rotating clockwise. Therefore, the cam module 7, the rotation plate 9 and the fixing plate 13 would stop rotating via the block 109 of the base 1 blocking the stopping portion 111 of the rotation disc 9 rotating clockwise and thus the sub-housing 202 of the mobile phone 200 is in the open position.

While the sub-housing 202 of the mobile phone 200 rotates on the main housing 201 of the mobile phone 200 anti-clockwise from the open position to the close position by receiving the external force, the rollers 35, 55 of the first and second elastic sliding portions 3, 5 gradually move out the second recess 715 and the fourth recess 735. The roller 55 of the second elastic sliding portion 5 move to the arc-shape projection portion 739 along the designed curve surface 731 of the lower cam 73. Thus the sliding shaft 51 of the second elastic sliding portion 5 slide to the groove 105 of the base 1 and pushes the compression spring 53. Therefore, the compression spring 53 is stored the pushed force from the sliding shaft 51 and thus the distance between the roller 55 and the groove 105 is getting close.

While the roller 55 of the second elastic 5 contacts the arc-shape projection portion 739 of the lower cam 73, the compression force stored in the compression spring 53 is therefore maximized and thus the distance between the roller 55 of the second elastic sliding portion 5 and the groove 105 of the base 1 is the shortest. While cam module 7 of the rotation hinge 100 still rotates anti-clockwise, the roller 55 of the second elastic portion 5 moves out the arc-shape projection portion 739 of the lower cam 73. Therefore, the cam module 7 is advanced to rotate anti-clockwise by the compression force releasing from the compression spring 53 of the second elastic sliding portion 5 and thus the sub-housing 202 of the mobile phone 200 would be brought to rotate anti-clockwise by the rotation hinge 100. The distance between the roller 55 of the second elastic sliding 5 and the groove 105 of the base 1 is getting far away.

While the cam module 7 of the rotation hinge 100 rotates anti-clockwise, the rotation plate 9 would be brought to rotate anti-clockwise by the tube 17. A second side 931 of the opening 93 of the rotation plate 9 opposite to the first side 930 of the opening 93 firstly contacts the second side 1111 of the stopping portion 111 of the rotation disc 11 (FIG. 6), and then the rotation disc 11 rotates anti-clockwise following the rotation plate 9. So the stopping portion 111 of the rotation disc 11 would leave the block 109 of the base 1.

While the cam module 7 of the rotation hinge 100 rotates anti-clockwise to the close position, the rollers 35, 55 of the first and second elastic sliding portions 3, 5 respectively back to the first recess 713 of the upper cam 71 and the third recess 733 of the lower cams 73. The distance between the rollers 35, 55 of the first and second elastic sliding portions 3, 5 and the grooves 103, 105 of the base 1 is still back to the longest. Therefore, the sub-housing 202 also rotates on the main housing 201 of the mobile phone 200 and back to the close position (as shown in FIG. 5).

Figure 11:
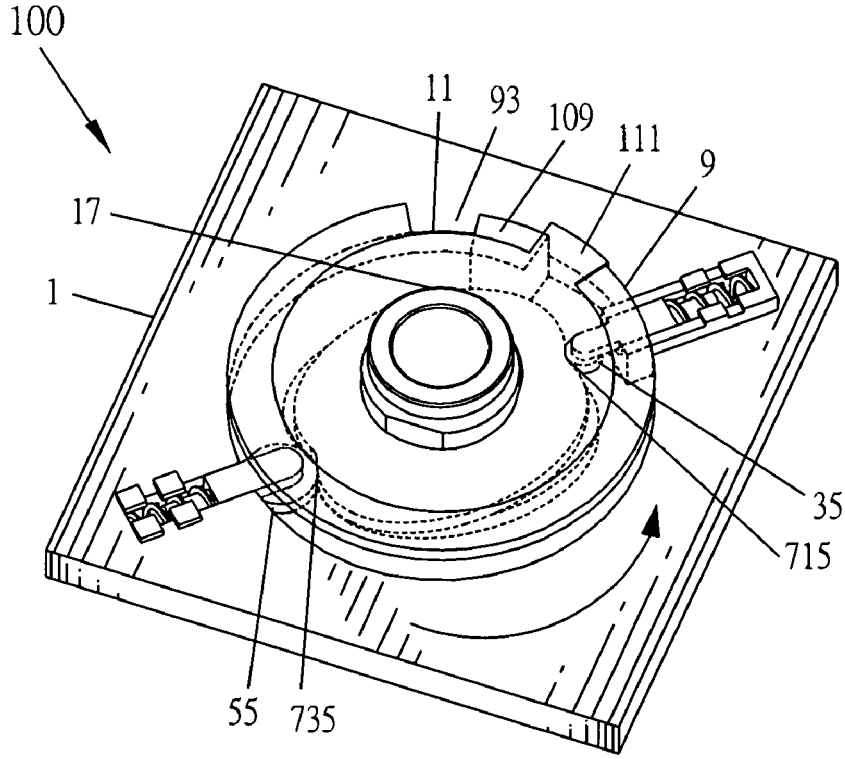
FIG. 11 is a perspective view showing that the rotation hinge may also rotate anti-clockwise to the open position in a different direction.

Please refer to FIG. 11. While the rotation hinge 100 rotates anti-clockwise from the close position to the open position by receiving the external force, firstly, the cam module 7 rotates anti-clockwise and the rollers 35, 55 of the first and second elastic sliding portions 3, 5 respectively move out the first recess 713 of the upper cam 71 and the third recess 733 of the lower cams 73. The sliding shafts 31, 51 of the first and second elastic sliding portions 3, 5 are respectively pushed to slide to the grooves 103, 105 by rotation of the cam module 7. Therefore, the sliding shafts 31, 51 respectively push the compression spring 33, 53 and the compression springs 33, 53 store compression force by receiving the pushed force from the sliding shafts 31, 51. The distance between rollers 35, 55 and the grooves 103, 105 are getting close.

While the roller 55 of the second elastic 5 just moves on the arc-shape projection portion 737, the compression force stored in the compression spring 53 of the second elastic sliding portion 5 is therefore maximized and thus the distance between the roller 55 and the groove 105 is the shortest. While cam module 7 of the rotation hinge 100 still rotates anti-clockwise, the roller 55 of the second elastic portion 5 moves out the arc-shape projection portion 737 of the lower cam 73. Therefore, the cam module 7 is advanced to rotate anti-clockwise by the compression force releasing from the compression spring 55 of the second elastic sliding portion 5 and thus the sub-housing 202 of the mobile phone 200 would be brought to rotate anti-clockwise by the cam module 7 of the rotation hinge 100. Therefore, the distance between the roller 55 of the second elastic sliding 5 and the groove 105 of the base 1 is getting far away.

Figure 12:
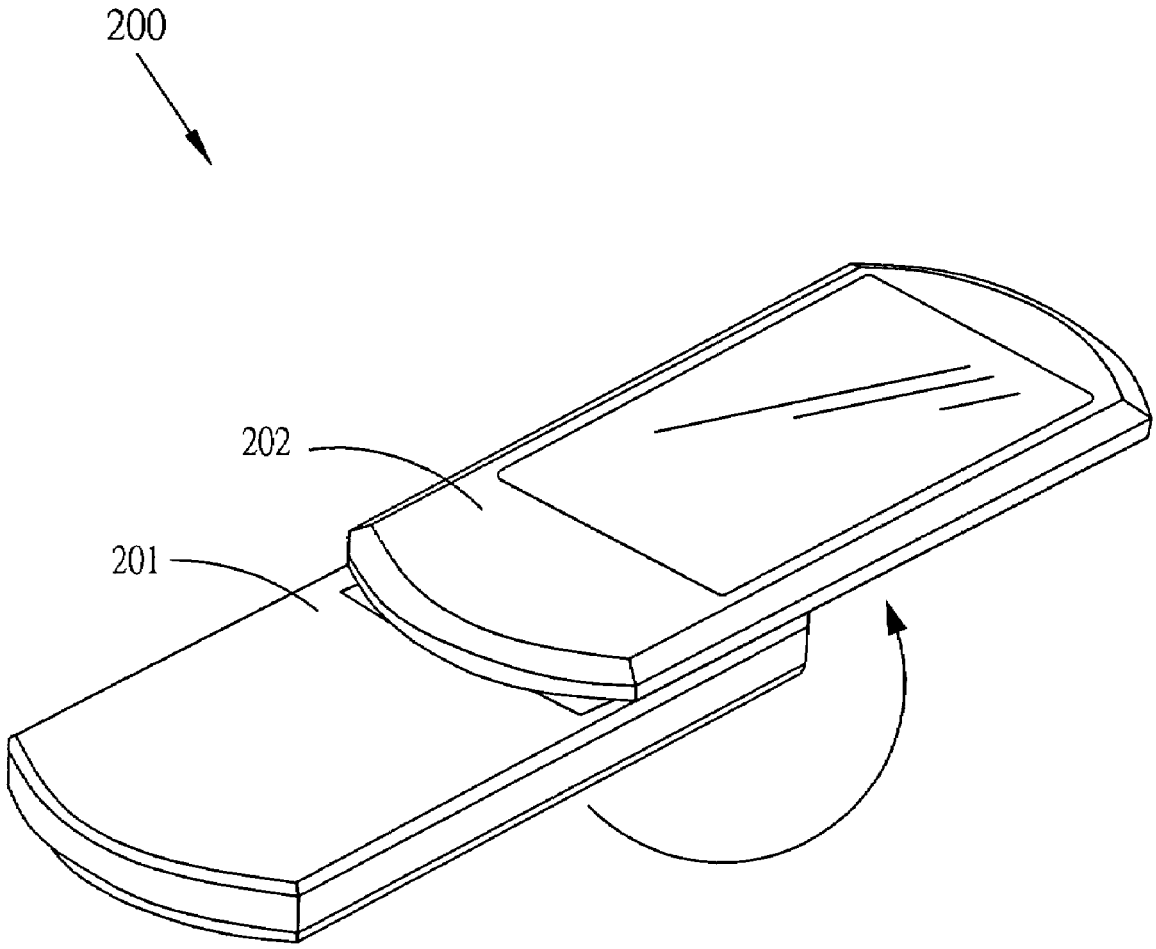
FIG. 12 is a portion perspective view showing the portable electrical device rotating anti-clockwise to the open position from another direction.

While the cam module 7 of the rotation hinge 100 rotates anti-clockwise to the open position, the rollers 35, 55 of the first and second elastic sliding portions 3, 5 respectively contact the second recess 715 of the upper cam 71 and the fourth recess 735 of the lower cam 73. The distance between the rollers 35, 55 of the first and second elastic sliding portions 3, 5 and the grooves 103, 105 of the base 1 is the longest. The first side 1110 of the stopping portion 111 of the rotation disc 11 contacts a second side 1091 of the of the block 109 of the base 1 opposite to the first side 1090 of the block 109 and then the block 109 blocks the stopping portion 111 rotating anti-clockwise. Therefore, the cam module 7, the rotation plate 9 and the fixing plate 13 would stop rotating via the block 109 of the base 1 blocking the stopping 111 of the rotation disc 9 rotating anti-clockwise and thus the sub-housing 202 of the mobile phone 200 is in the open position (as shown in the FIG. 12).

While the sub-housing 202 rotates on the main housing 201 of the mobile phone 200 clockwise from the open position to the close position by receiving the external force, the rollers 35, 55 of the first and second elastic sliding portions 3, 5 move out the second recess 715 of the upper cam 71 and the fourth recess 735 of the lower cam 73. The roller 35 of the first elastic sliding portion 5 progressively moves to the arc-shape projection portion 717 of the upper cam 71 along the designed curve surface 711 of the upper cam 71. The sliding shaft 31 of the first elastic sliding portion 3 also progressively slides to the groove 103 of the base 1 and pushes the compression spring 33. Therefore, the compression force receiving from the sliding shaft 31 is progressively stored in the compression spring 33 and the distance between the roller 35 and the groove 103 is getting close.

While the roller 35 of the first elastic 3 exactly moves on the arc-shape projection portion 717, the compression force stored in the compression spring 33 is therefore maximized and thus the distance between the roller 35 of the first elastic sliding portion 3 and the groove 103 of the base 1 is the shortest. While cam module 7 of the rotation hinge 100 still rotates clockwise, the roller 35 of the first elastic portion 3 moves out the arc-shape projection portion 717 of the upper cam 71. Therefore, the cam module 7 is advanced to rotate clockwise by the compression force releasing from the compression spring 33 of the first elastic sliding portion 3 and thus the sub-housing 202 of the mobile phone 200 would be brought to rotate clockwise by the rotation hinge 100. The distance between the roller 35 of the first elastic sliding 3 and the groove 103 of the base 1 is getting far away.

While the cam module 7 of the rotation hinge 100 rotates clockwise to back the close position, the rollers 35, 55 of the first and second elastic sliding portions 3, 5 are respectively back to the first recess 713 of the upper cam 71 and the third recess 733 of the lower cam 73. The distance between the rollers 35, 55 of the first and second elastic sliding portions 3, 5 and the grooves 103, 105 of the base 1 is still back to the longest. Therefore, the sub-housing 202 also rotates on the main housing 201 of the mobile phone 200 to back to the close position (as shown in FIG. 5).

The operation of the rotation hinge 100 via the first elastic sliding portion 3 and the upper cam 71 of the cam module 7 to make the sub-housing 202 be advanced rotating on the main housing 201 of the mobile phone 200 clockwise to the open position and the close position. Furthermore, the rotation hinge 100 via the second elastic sliding portion 5 and the lower cam 73 of the cam module 7 to make the sub-housing 202 be advanced rotating on the main housing 201 of the mobile phone 200 anti-clockwise to the open position and the close position. The block 109 of the base 1 blocks the stopping portion 111 of the rotation disc 11 rotating clockwise and anti-clockwise for limiting the rotation range. That is to say, the rotation hinge 100 only receives the external fore and then is advanced to rotate clockwise and anti-clockwise to the open position and the close position and thus the sub-housing 202 of the mobile phone 200 is advanced to rotate on the main housing 201 of the mobile phone 200 clockwise and anti-clockwise to the open position and the close position.

The foregoing description of various implementations has been presented for the purposes of illustration and description. It is not intended to be exhaustive or to limit the scope to the precise form disclosed. Many modifications and variations are possible in light of the above teaching. Such modifications and variations are intended to be included within the scope of this invention as defined by the accompanying claims.

What is claimed is:

1. A rotation hinge, comprising:

a base having a receiving space formed in a surface of said base, and a first groove and a second groove respectively horizontally arranged at said base, one end of said first and second grooves respectively leading to said receiving space, said first groove arranged higher than said second groove;

a cam module received in said receiving space of said base and having an upper cam with a first designed curve surface, and a first recess and a second recess respectively arranged at said first designed curve surface and an arc-shape projection portion positioned on each section between said first and second recesses, wherein said first and second recesses respectively adjoining one said arc-shape projection portion;

a lower cam connected to said upper cam having a second designed curve surface, and a third recess and a fourth recess respectively arranged at said second designed curve surface, said arc-shape projection portion positioned on each section between said third and fourth recesses, wherein said third and fourth recesses respectively adjoining one said arc-shape projection portion, and said arc-shape projection portion of said upper cam exclusively positioned to said arc-shape projection portion of said lower cam;

a first elastic sliding portion received in said first groove and contacting said first recess; and a second elastic sliding portion received in said second groove and contacting said third recess, wherein while said first elastic sliding portion contacting said arc-shape projection portions of said upper cam or said second elastic sliding portion contacting said arc-shape projection portions of said lower cam, compression force stored in said first or second elastic sliding portion is maximized.

2. The rotation hinge as claimed in claim 1, wherein said first elastic sliding portion comprises a sliding shaft, said sliding shaft passing through a compression spring and received in said first groove, said sliding shaft coupled to a roller and contacting said first recess.

3. The rotation hinge as claimed in claim 1, wherein said base comprises a first through hole perpendicularly through said base, said cam module comprises a first engaging through hole perpendicularly through said cam module.

4. The rotation hinge as claimed in claim 3, further comprising a tube sequentially passing through said first through hole and said first engaging through hole, and engaging with said first engaging through hole.

5. The rotation hinge as claimed in claim 4, further comprising a fixing plate located upon said cam module comprising a third engaging through hole perpendicularly through said fixing plate for engaging with said tube, a riveting plate located upon said fixing plate and engaged with said tub.

6. The rotation hinge as claimed in claim 5, further comprising a main housing coupled to said base, a sub-housing coupled to said fixing plate.

7. The rotation hinge as claimed in claim 5, wherein said riveting plate is an E-ring.

8. The rotation hinge as claimed in claim 5, wherein said fixing plate comprises at least one fixing portion arranged at an edge of said fixing plate for coupling to said sub-housing.

9. The rotation hinge as claimed in claim 5, further comprising a rotation plate located between said cam module and said fixing plate and having a rotation space formed in a surface of said rotation plate, an opening arranged at a side of said rotation plate and communicating with said rotation space and a second engaging through hole perpendicularly through said rotation plate for engaging with said tube;

a rotation disc received in said rotation space and having a stopping portion projecting from an edge of said rotation disc and located in said opening of said rotation plate and a second through hole perpendicularly through said rotation disc; and a block positioned in said receiving space of said base and connected to inner wall of said receiving space of said base.

10. The rotation hinge as claimed in claim 9, wherein said tube comprises a post-shape body, a bottom portion arranged at one end of said post-shape body and a neck portion formed in the other end of said post-shape body, wherein a diameter of said bottom portion is bigger than a diameter of said post-shape body and a diameter of said neck portion is smaller than said diameter of said post-shape body, while said rotation hinge is assembled, said post-shape body sequentially passes through said first through hole, said first engaging through hole, said second engaging through hole, said second through hole and said third engaging through hole, said bottom portion of said tube contacts a bottom surface of said base and said riveting plate engages with said neck portion of said tube.

11. The rotation hinge as claimed in claim 6, wherein said main housing and said sub-housing are portions of a portable electrical device.

12. The rotation hinge as claimed in claim 11, wherein said portable electrical device is a mobile phone.

13. A rotation hinge comprising:

a base having a receiving space formed in a surface of said base, a first groove horizontally arranged at said base and leaded to said receiving space, and a first through hole perpendicularly through said base;

a cam module received in said receiving space of said base having an upper cam with a first designed curve surface having a first recess, a second recess, and an arc-shape projection portion positioned on each section between said first and second recesses, said first and second recesses respectively adjoining one said arc-shape projection portion, a lower cam with a second designed curve surface having a third recess, a fourth recess, and said arc-shape projection portion positioned on each section between said third and fourth recesses, said third and fourth recesses respectively adjoining one said arc-shape projection portion, wherein said arc-shape projection portion of said upper cam exclusive said arc-shape projection portion of said lower cam, and a first engaging through hole perpendicularly through said cam module;

a first elastic sliding portion received in said first groove and contacting said first recess;

a fixing plate located upon said cam module and having a third engaging through hole perpendicularly through said fixing plate; and a tube sequentially passing through said first through hole of said base, said first engaging through hole of said cam module and said third engaging through hole of said fixing plate.

14. The rotation hinge as claimed in claim 13, further comprising a riveting plate located upon said fixing plate for engaging with said tube.

15. The rotation hinge as claimed in claim 13, further comprising a rotation plate located between said cam module and said fixing plate and having a rotation space formed in a surface of said rotation plate, an opening arranged at one side of said rotation plate and communicating with said rotation space, and a second engaging through hole perpendicularly through said rotation plate for engaging with said tube; a rotation disc received in said rotation space with a stopping portion projecting from an edge of said rotation disc and located in said opening of said rotation plate, and a second through hole perpendicularly through said rotation disc; and a block positioned in said receiving space of said base and connected to inner wall of said receiving space of said base.

16. The rotation hinge as claimed in claim 13, wherein said base comprises a second groove horizontally arranged at said base and arranged lower than said first groove, said second groove leading to said receiving space of said base and received a second elastic sliding portion.

17. The rotation hinge as claimed in claim 13, wherein said first elastic sliding portion comprises a first sliding shaft, said first sliding shaft passing through a first compression spring and received in said first groove, said first sliding shaft coupled to a first roller and contacting said first recess.

18. The rotation hinge as claimed in claim 16, wherein said second elastic sliding portion comprises a second sliding shaft, said second sliding shaft passing through a second compression spring and received in said first groove, said second sliding shaft coupled to a second roller and contacting said first recess.

19. The rotation hinge as claimed in claim 13, wherein said tube comprises a post-shape body for passing through said first through hole, said first engaging through hole, said second engaging through hole, said second through hole and said third engaging through hole, a bottom portion arranged at one end of said post-shape body for contacting a bottom surface of said base, and a neck portion formed in the other end of said post-shape body for engaging with said riveting plate, a diameter of said bottom portion is bigger than a diameter of said post-shape body and a diameter of said neck portion is smaller than said diameter of said post-shape body.

* * * * *